US007720420B2

(12) United States Patent
Kajita

(10) Patent No.: US 7,720,420 B2
(45) Date of Patent: May 18, 2010

(54) FIXING DEVICE FOR THERMALLY FIXING AN IMAGE DEVELOPED ON A RECORDING SHEET AND USE WITH AN IMAGE-FORMING APPARATUS

(75) Inventor: Masahito Kajita, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 11/845,949

(22) Filed: Aug. 28, 2007

(65) Prior Publication Data

US 2008/0056750 A1 Mar. 6, 2008

(30) Foreign Application Priority Data

Aug. 28, 2006 (JP) ..... 2006-230448

(51) Int. Cl.
*G03G 15/20* (2006.01)

(52) U.S. Cl. ..... 399/320; 399/70

(58) Field of Classification Search ..... 399/33, 399/88, 122, 328, 320, 70
See application file for complete search history.

(56) References Cited

U.S. PATENT DOCUMENTS 5,115,119 A * 5/1992 Adachi et al. ..... 219/469
6,463,251 B2 * 10/2002 Kiuchi ..... 399/330
2002/0057919 A1 * 5/2002 Tomatsu ..... 399/69
2005/0265743 A1 * 12/2005 Kubo ..... 399/69

FOREIGN PATENT DOCUMENTS

| | | | |
|---|---|---|---|
| JP | 6218580 | | 1/1987 |
| JP | 62030280 | | 2/1987 |
| JP | 01300281 | | 12/1989 |
| JP | 02135481 | A * | 5/1990 |
| JP | 03265879 | | 11/1991 |
| JP | 04274471 | | 9/1992 |
| JP | 08048432 | | 2/1996 |

* cited by examiner

*Primary Examiner*—Quana M Grainger
(74) *Attorney, Agent, or Firm*—Banner & Witcoff, Ltd.

(57) ABSTRACT

A fixing device thermally fixes an image developed on a recording sheet. The fixing device includes: a heating roller heated by a heat source and having a first end side and a second end side with respect to an axial direction; a power supply member for supplying the heat source with power for use in heating the heating roller; a first bearing formed of a conductive material, attached to the first end side of the heating roller and connected to a ground; and an second bearing formed of an insulating material and attached to the second end side of the heating roller. The power supply member is disposed at the second end side of the heating roller.

19 Claims, 5 Drawing Sheets

FIXING DEVICE FOR THERMALLY FIXING AN IMAGE DEVELOPED ON A RECORDING SHEET AND USE WITH AN IMAGE-FORMING APPARATUS

CROSS-REFERENCE TO RELATED APPLICATIONS

This application is based upon and claims the benefit of priority from Japanese Patent Application No. 2006-230448, filed on Aug. 28, 2006, the entire contents of which are incorporated herein by reference.

TECHNICAL FIELD

The present invention relates to a fixing device for thermally fixing an image developed on paper (a recording sheet) and an image forming apparatus including the fixing device.

BACKGROUND

An image forming apparatus, such as a laser printer, is generally includes a fixing device for thermally fixing an image transferred to the sheet from a photosensitive element. JP-A-8-48432 discloses a fixing device including a heating roller heated by a heat source, a pressing roller pressed toward the heating roller, and a bearing that rotatably supports the heating roller and that is formed of a conductive resin. According to this device, an earth plate is connected to the bearing formed of conductive resin, thereby allowing electric charges accumulated in the heating roller to be discharged. Depending on the structure of the fixing device, there is a case where a conductive member for supplying power to the heat source and a power supply member having a thermal fuse as a safety device are disposed in the vicinity of the bearing of the heating roller.

However, in a case where the bearing is formed of a conductive resin and the power supply member is disposed in the vicinity of the bearing, when the bearing has become fused as a result of occurrence of a failure in temperature control of the heating roller, the fused bearing may contact the power supply member. When the bearing contacts the power supply member as mentioned above, a short circuit arises between the power supply member and the heating roller by way of the conductive bearing. This may eventually result in infliction of damage on the fixing device.

SUMMARY

According to a first aspect of the invention, there is provided a fixing device for thermally fixing an image developed on a recording sheet, including: a heating roller heated by a heat source and having a first end side and a second end side with respect to an axial direction; a power supply member for supplying the heat source with power for use in heating the heating roller; a first bearing formed of a conductive material, attached to the first end side of the heating roller and connected to a ground; and an second bearing formed of an insulating material and attached to the second end side of the heating roller, wherein the power supply member is disposed at the second end side of the heating roller.

According to a second aspect of the invention, there is provided a fixing device for thermally fixing an image developed on a recording sheet, including: a heating roller heated by a heat source; a temperature fuse that shuts off a power supply when a predetermined temperature or more is achieved and disposed to oppose to a circumferential face of the heating roller; and a cylindrical insulating tube that sheathes the temperature fuse, wherein an axial direction of the insulating tube is aligned with the heating roller, and the insulating tube is rotatably arranged around the temperature fuse.

According to a third aspect of the invention, there is provided an image forming apparatus for forming an image on a recording sheet, including: an exposure device that performs a scanning operation with a laser beam in accordance with an input signal of the image; a photosensitive element subjected to the scanning operation, whereby an electrostatic latent image is formed; a developing unit that supplies the photosensitive element with developer; a transfer unit that transfers a developed image formed from the developer onto the recording sheet; and a fixing device that thermally fixes the developed image on the recording sheet, wherein the fixing device includes: a heating roller heated by a heat source and having a first end side and a second end side with respect to an axial direction; a power supply member for supplying the heat source with power for use in heating the heating roller; a first bearing that is formed of a conductive material and attached to the first end side of the heating roller and connected to a ground; and an first bearing that is formed of an insulating material and attached to the second end side of the heating roller wherein the power supply member is disposed at the second end side of the heating roller.

According to a fourth aspect of the invention, there is provided an image forming apparatus for forming an image on a recording sheet, including: an exposure device that performs a scanning operation with a laser beam in accordance with an input signal of the image; a photosensitive element subjected to the scanning operation, whereby an electrostatic latent image is formed; a developing unit that supplies the photosensitive element with developer; a transfer unit that transfers a developed image formed from the developer onto the recording sheet; and a fixing device that thermally fixes the developed image on the recording sheet, wherein the fixing device includes: a heating roller heated by a heat source; a temperature fuse that shuts off a power supply when a predetermined temperature or more is achieved and disposed to oppose to a circumferential face of the heating roller; and a cylindrical insulating tube which sheathes the temperature fuse, wherein an axial direction of the insulating tube is aligned with the heating roller, and the insulating tube is rotatably arranged around the temperature fuse.

DESCRIPTION

First Embodiment

<Overall Configuration of Laser Printer>

Figure 1:
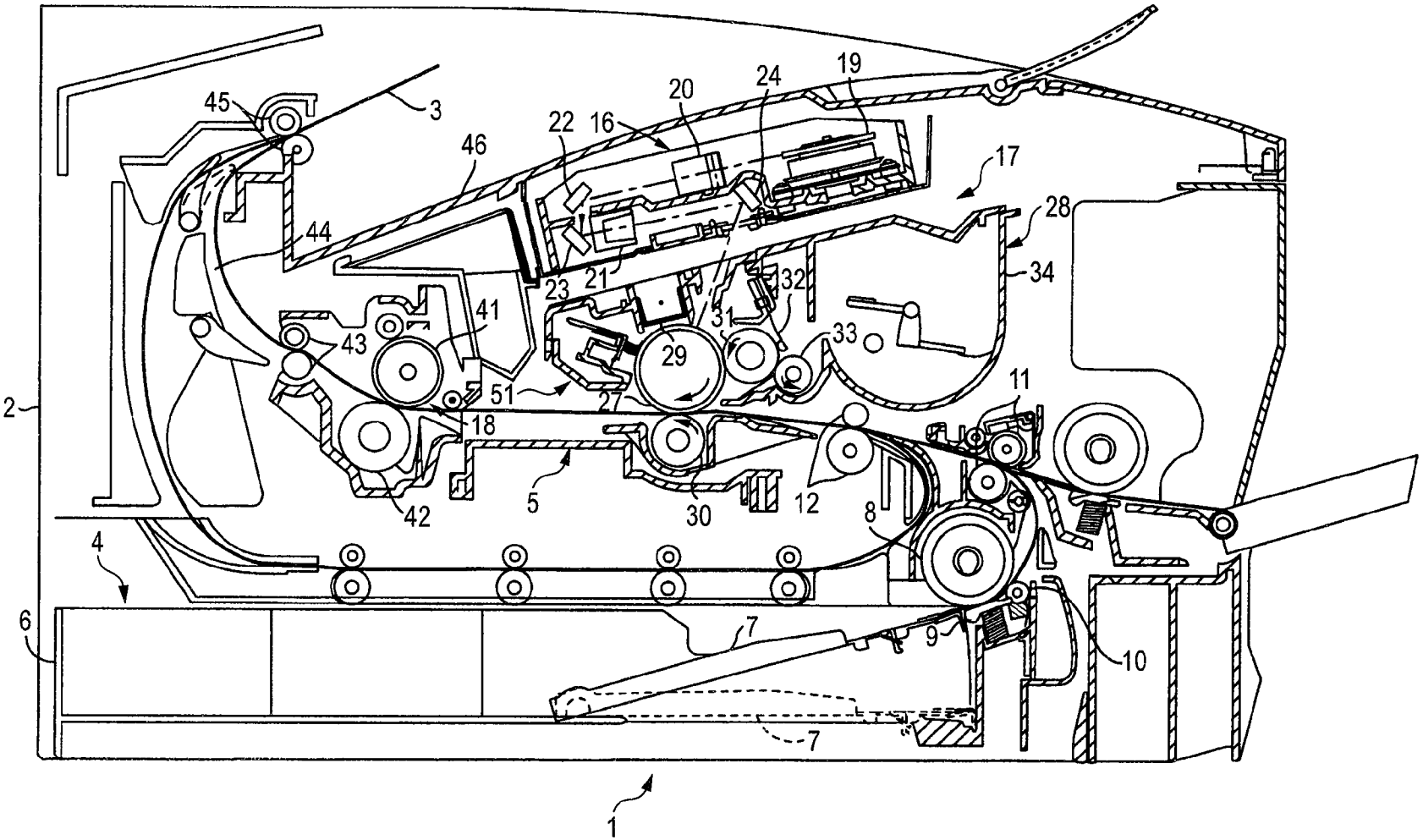
FIG. 1 is a side cross-sectional view showing a laser printer serving as an example image forming apparatus of a first embodiment of the present invention.

An overall configuration of a laser printer serving as an exemplification of an image forming apparatus of the present invention will first be described briefly. FIG. 1 is a side cross-sectional view showing the laser printer serving as an exemplification of the image forming apparatus of a first embodiment of the present invention.

As shown in FIG. 1, a laser printer 1 includes a feeder unit 4 for feeding sheets 3 into a main-unit casing 2 and an image forming unit 5 for forming an image on the supplied sheet 3.

<Structure of the Feeder Unit>

The feeder unit 4 includes a sheet-feeding tray 6 removably attached to an inner bottom of the main-unit casing 2 and a sheet-pressing plate 7 provided within the sheet-feeding tray 6. The feeder unit 4 also includes a sheet-feeding roller 8 and a sheet-feeding pad 9 which are disposed at elevated positions above an end of one end side of the sheet-feeding tray 6; and paper-dust rollers 10, 11 which are disposed at downstream positions with respect to the paper-feeding roller 8 in a direction in which the sheet 3 is conveyed (hereinafter called a "conveying direction"). The feeder unit 4 additionally includes register rollers 12 disposed downstream with respect to the paper-dust rollers 10 and 11. In the following descriptions, there is a case where a downstream side and an upstream side in the conveying direction of the sheet 3 are called simply a downstream side and an upstream side.

In the feeder unit 4 constructed as mentioned above, the sheets 3 in the paper-feeding tray 6 are pulled toward the paper-feeding roller 8 by means of the sheet press plate 7. The sheets are then fed by means of the sheet-feeding roller 8 and the sheet-feeding pad 9 and conveyed one at a time to the image forming unit 5 after having passed through the various types of rollers 10 to 12.

<Structure of the Image Forming Unit>

The image forming unit 5 has a scanner unit 16, a process cartridge 17, a fixing device 18, and the like.

<Structure of the Scanner Unit>

The scanner unit 16 is disposed at an elevated position within the main-unit casing 2. The scanner unit 16 includes a laser-emitting unit (not shown), a polygon mirror 19 to be rotationally driven, lenses 20 and 21, reflecting mirrors 22, 23, 24, and others. A laser beam, which is determined by image data and which is emitted from the laser-emitting unit, sequentially passes through or undergoes reflection on the polygon mirror 19, the lens 20, the reflecting mirrors 22 and 23, the lens 21, and the reflecting mirror 24. The laser beam is then radiated over a surface of a photosensitive drum 27 by means of a high-speed scanning.

<Structure of the Process Cartridge>

The process cartridge 17 is disposed below the scanner unit 16 and removably attached to the main-unit casing 2. A developing cartridge 28, a photosensitive drum 27, a scorotron-type charging device 29, and a transfer roller 30 are primarily provided within a hollow housing 51 constituting an exterior framework of the process cartridge 17.

The developing cartridge 28 is removably attached to the housing 51 and includes a developing roller 31, a layer thickness regulation blade 32, a feed roller 33, and a toner hopper 34. Toner in the tonner hopper 34 is supplied to the developing roller 31 by means of rotation of the feed roller 33 in an arrowed direction (a counterclockwise direction). At this time, toner is positively electrified between the feed roller 33 and the developing roller 31. The toner fed over the developing roller 31 enters between the layer thickness regulation blade 32 and the developing roller 31 in association with rotation of the developing roller 31 in the arrowed direction (the counterclockwise direction), and held as a thin layer of given thickness over the developing roller 31.

The photosensitive drum 27 is supported by the housing 51 so as to be rotatable in an arrowed direction (a clockwise direction). A drum main body of this photosensitive drum 27 is connected to a ground, and a surface of the photosensitive drum 27 is formed of a photosensitive layer whose surface is formed of polycarbonate and which exhibits positive charging properties.

The scorotron-type charging device 29 is disposed above and opposite the photosensitive drum 27 with a predetermined space, to thus avoid contacting the photosensitive drum 27. This scorotron-type charging device 29 is used for positive charging purpose which produces a corona discharge from a charting wire, such as a tungsten wire, and which is configured to uniformly charge the surface of the photosensitive drum 27 with positive charges.

The transfer roller 30 is disposed to contact the photosensitive drum 27 and supported by the housing 51 so as to be rotatable in the arrowed direction (the counterclockwise) This transfer roller 30A is constructed by means of sheathing a metallic roller shaft with a conductive rubber material. At the time of transfer operation, a transfer bias is applied to this transfer roller 30.

After having been uniformly electrified with positive electric charges by means of the scorotron-type charging device 29, the surface of the photosensitive drum 27 is exposed by means of a high-speed scan of a laser beam from the scanner unit 16. As a result, an electric potential of an exposed area is decreased, whereby an electrostatic latent image is formed in accordance with image data. Here, the word "electrostatic latent image" means an exposed area, of which electric potential has decreased upon exposure to the laser beam, in a uniformly, positively-charged surface of the photosensitive drum 27. Next, when the toner held over the developing roller 31 opposes and contacts the photosensitive drum 27 by rotating the developing roller 31, the toner is supplied to the electrostatic latent image formed on the surface of the photosensitive drum 27. As a result of toner being selectively held over the surface of the photosensitive drum 27, the electrostatic latent image is made visible. Thus, a toner image is formed by means of discharged-area development.

Subsequently, the photosensitive drum 27 and the transfer roller 30 are rotationally driven such that the sheet 3 is conveyed while being nipped between the drum 27 and the roller 30. Thus, the toner image held over the surface of the photosensitive drum 27 is transferred onto the sheet 3.

<Structure of the Fixing Device>

The fixing device 18 is disposed at a downstream position with respect to the process cartridge 17. The fixing device 18 includes a heating roller 41, a pressing roller 42 pressed toward the heating roller 41, and a pair of conveyor rollers (a conveyor roller pair) 43 disposed downstream with respect to the heating roller 41 and the pressing roller 42. The fixing device 18 thermally fixes the toner image transferred on the sheet 3 during the course of the sheet 3 passing between the heating roller 41 and the pressing roller 42. Subsequently, the sheet 3 is conveyed to a sheet discharge path 44 by means of the conveyor roller pair 43. The sheet 3 conveyed to the sheet discharge path 44 is discharged onto a sheet discharge tray 46 by means of sheet discharge rollers 45.

<Detailed Structure of the Fixing Device>

Figure 2:
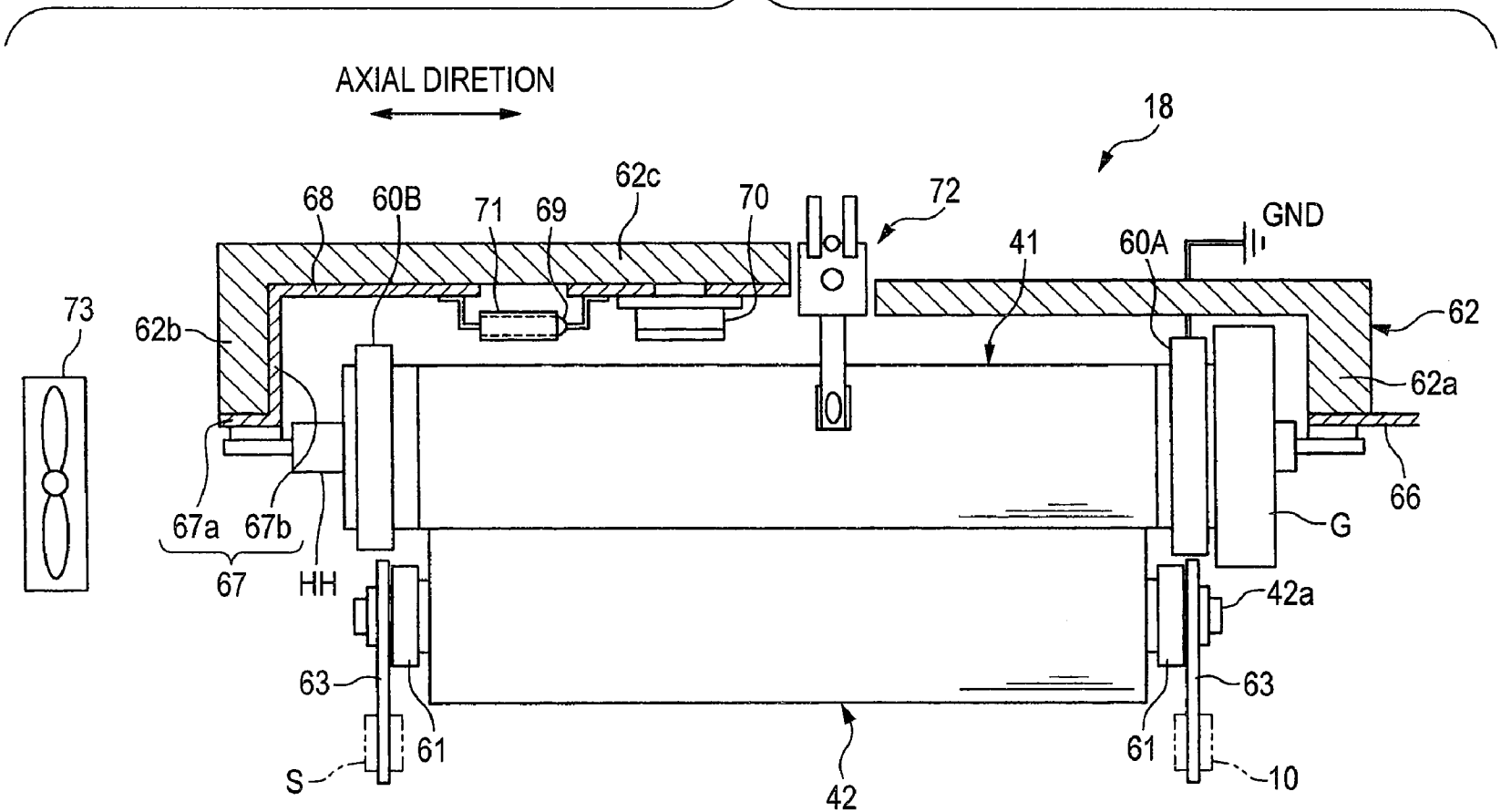
FIG. 2 is a schematic view showing a relationship among components of a fixing device of the laser printer shown in FIG. 1.
Figure 3:
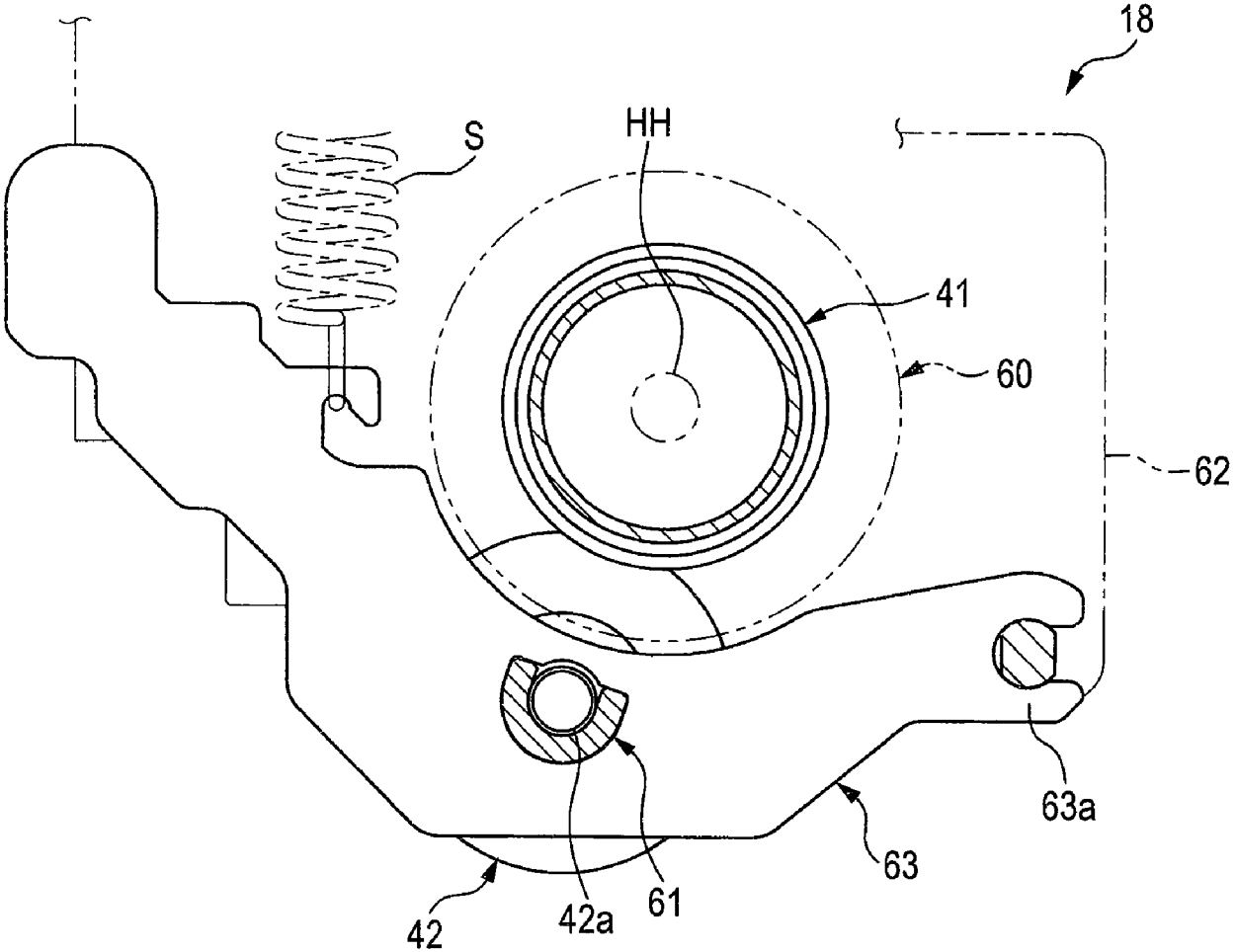
FIG. 3 is a side view showing the relationship among the respective components of the fixing device of the laser printer shown in FIG. 1.

The detailed structure of the fixing device will now be described. FIG. 2 is a schematic view showing a relationship among elements of the fixing device of the laser printer shown in FIG. 1, and FIG. 3 is a side view showing the relationship among the respective elements of the fixing device of the laser printer shown in FIG. 1. The previously-described structure of the fixing device shown in FIG. 1 is omitted, as required, for the sake of description.

As shown in FIG. 2, in addition to the heating roller 41 and the pressing roller 42, the fixing device 18 also includes a conductive resin bearing 60A and an insulating resin bearing 60B for the heating roller 41, a bearing 61 for the pressing roller (a pressing roller bearing), a housing 62, and pressure arms 63.

The heating roller 41 has into a hollow, cylindrical shape and is to be heated by means of a halogen heater HH incorporated in the roller 41. This heating roller 41 is supported rotatably by the housing 62 by way of the conductive resin bearing 60A and the insulating resin bearing 60B (a supported area is not illustrated).

A gear G is fastened to one end of the heating roller 42. Thus, as a result of transmission of driving force from a driving unit (not shown) to the heating roller 41 by way of the gear G, the heating roller 41 is rotated. The conductive resin bearing 60A is attached to one end side of the heating roller 41, and the insulating resin bearing 60B is attached to the other end side of the heating roller 41.

The conductive resin bearing 60A is formed of a conductive resin and is connected to the ground by way of a metallic wire etc. connected to an appropriate point on the bearing. Any resin may also be adopted as a conductive resin. It is better to adopt; for example, conductive PPS (polyphenylene sulfide), conductive PC (polycarbonate), conductive POM (polyacetal), and the like.

The insulating resin bearing 60B is formed of an insulating resin. Any resin may also be adopted as a insulating resin. It is better to adopt; for example, insulating PPS (polyphenylene sulfide), insulating POM, and the like, The pressing roller 42 has a cylindrical shape. A rotary shaft 42*a* is provided so as to protrude to the outside from the center of each end of the roller 24. This rotary shaft 42*a* is supported rotatably by means of the pressing roller bearing 61. The pressing roller 42 is an example of a pressing member. The pressing member is not limited to a cylindrical roller, and may be other configuration such as a belt.

As shown in FIG. 3, the pressure arms 63 has an elongated shape and presses (urges) the pressing roller 42 toward the heating roller 41 as by urging toward the heating roller 41 by means of a tension spring S. One end 63*a* of each pressure arm 63 is supported rotatably by the housing 62. The substantially center of each pressure arm 63 supports the pressing roller bearing 61, and the other end side of the same is urged by the tension spring S.

As shown in FIG. 2, the housing 62 mainly includes a pair of sidewalls 62*a* and 62*b*, which oppose respective end faces of the heating roller 41, and an upper wall 62*c* disposed at a position across the heating roller 41 from the pressing roller 42. Of the sidewalls 62*a* and 62*b*, the sidewall 62*a* is provided with a first electrode 66 connected to one end of the halogen heater HH, and the other sidewall 62*b* is provided with a second electrode 67 connected to the other end of the halogen heater HH.

The second electrode 67 is formed to have an L-shaped in cross-section and includes a connection portion 67*a* connected to the halogen heater HH and a first conductive portion 67*b* provided along an inner surface of the sidewall 62*b*. In order to supply power to the second electrode 67, a second conductive portion 68 for transmitting electricity from an external power supply to the second electrode 67 is formed integrally to the first conductive portion 67*b* of the second electrode 67. This second conductive portion 68 is provided along an inner surface of the upper wall 62*c* of the housing 62. The halogen heater HH is activated by power supplied from the external power supply to the second conductive portion 68 and the first electrode 66 by way of a channel such as an electric wire (not shown).

The second conductive portion 68 is provided with, as appropriate, a temperature fuse 69 and a thermostat 70. The second conductive portion 68, the temperature fuse 69, and the thermostat 70 are provided at the other end side of the heating roller 41 (the side of the roller 41 where the insulating resin bearing 60B is provided) as well as on the side across the heating roller 41 from the pressing roller 42.

A fuse element which is fused as a result of an increase in ambient temperature is provided in the temperature fuse 69. When the temperature of the heating roller 41 has reached a predetermined temperature or more, the temperature fuse is fused, thereby physically shutting off circuitry and the power supply. The temperature fuse 69 is disposed in the vicinity of the other end of the heating roller 41, thereby detecting the temperature of the other end of the heating roller 41. This temperature fuse 69 is sheathed with a cylindrical insulating tube 71.

The insulating tube 71 is a cylindrical element formed of an insulating material, such as a resin. The axial direction of the insulating tube 71 is aligned with the longitudinal direction of the heating roller 41 so as to be rotatable with respect to the temperature fuse 69. Specifically, this insulating tube 71 is rotatable along the circumferential direction of the outer peripheral surface of the substantially cylindrical temperature fuse 69. Here, the insulating tube 71 may be: an element that is formed by cylindrically rolling a plastic film or an insulating tape and connecting the thus-rolled film or tape; a plastic molded article or a rubber molded article cylindrically formed by means of a molding die; or the like.

The thermostat 70 has spherical bimetal. When a given temperature or higher is reached, the bimetal is inverted, to thus turn off a switch and physically shut off circuitry. This thermostat 70 is disposed at a position close to the substantial center of the heating roller 41, thereby reacting to the temperature of the substantial center of the heating roller 41. Anything may also be adopted as the thermostat, so long as it physically shuts off circuitry. Moreover, an element for electrically shutting off circuitry in accordance with a signal from a sensor may also be applied instead of the thermostat.

A thermistor 72 for detecting the temperature of the substantial center of the heating roller 41 is provided in the vicinity of the thermostat 70 (at a position opposite to the temperature fuse 69). A signal detected by this thermistor 72 is output to a controller (not shown), and this controller controls electric current according to the temperature for the heating roller 41.

The present embodiment mentions, as examples of the power supply member, the second conductive portion 68, the temperature fuse 69, and the thermostat 70. However, the present invention is not limited to this embodiment. For instance, only the second conductive portion 68 and the temperature fuse 69 may also be taken as the power supply members and disposed opposite the heating roller 41.

An intake-type exhaust fan 73 for discharging an air from one end side of the heating roller 41 to the other end side thereof is placed at the other end side of the heating roller 41 (the opposite side of the gear G) so as to oppose the end face of the heating roller 41.

Next, operation of the controller (the thermistor 72), the thermostat 70, and the fuse 69 is described. Subsequently, operation of the heating roller 41 and other operations performed when these elements fail to operate properly will be described.

<Operation of the Controller>

The thermistor 72 detects the temperature of the substantial center of the heating roller 41 at all time, and the detected temperature is output as temperature information to the controller (not shown). This controller appropriately controls electric current in accordance with the temperature information from the thermistor 72.

<Thermostat 70>

When an increase in the temperature of the heating controller 41 is not prevented by current control of the controller, circuitry is physically shut off by means of switching operation of the thermostat 70.

<Operation of the Temperature Fuse 69>

When a large number of sheets 3 is printed consecutively, there sometimes arises a case where heat of the substantial center of the heating roller 41 is intensively deprived by the sheets 3 passing through the substantial centers of the respective rollers 41 and 42. When such a phenomenon of intensive deprivation of heat from the substantial center of the heating roller 41 has arisen, an anomalous increase occurs in the temperatures of both ends of the heating roller 41 even when a normal temperature is acquired at the substantial center of the heating roller 41. In such a case, the thermostat 70 does not shut off circuitry, but the temperature fuse 69 instead physically breaks a line, to thus shut off circuitry.

<A Case Where the Thermostat 70 and the Temperature Fuse 69 Do Not Operate>

For instance, in the event that the temperature fuse 69 is broken when a large number of sheets 3 is printed consecutively as mentioned previously, the temperatures of both ends of the heating roller 41 increase. At this time, the air in the fixing device 18 flows from one end side of the heating roller 41 (i.e., the side of the heating roller opposing the gear G) toward the other side of the same by means of ventilation of the exhaust fan 73. Therefore, an increase rises particularly in the temperature of the other end side of the heating roller 41.

When a temperature has increased such as that mentioned above, the insulating resin bearing 60B disposed at the other end side of the heating roller 41 is first fused, and the conductive resin bearing 60A is fused subsequently. Thus, the bearings 60B and 60A are fused one after another with a predetermined time lag, whereupon the heating roller 41 is pressed toward the second conductive portion 68 by the pressing roller 42 while one end side of the heating roller 41 undergoes resistance.

Figure 4:
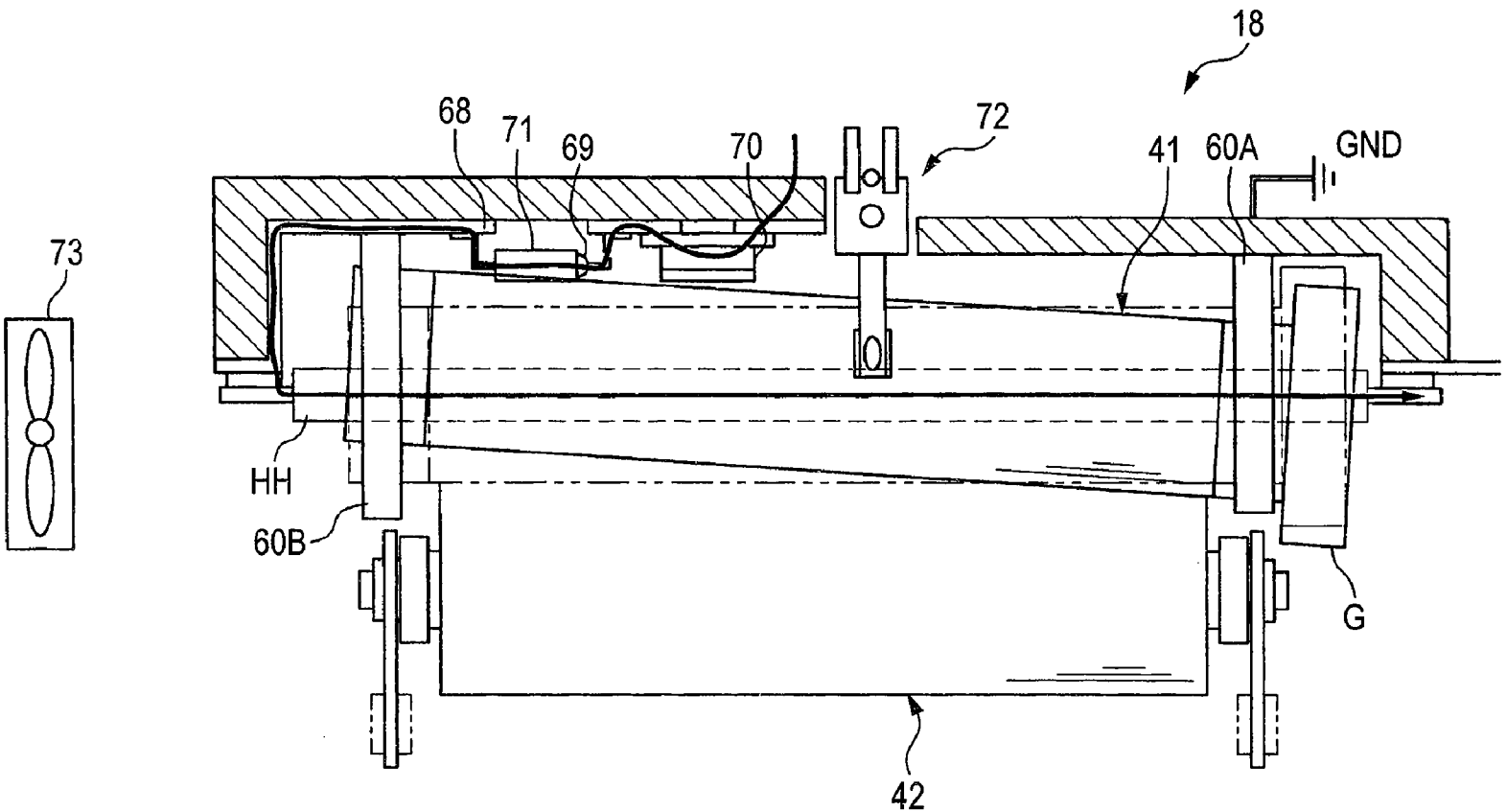
FIG. 4 is a schematic diagram showing movement of a heating roller achieved when a bearing has become fused and flow of an electric current.

Therefore, as shown in FIG. 4, the other end side of the heating roller 41 moves to the second conductive portion 68 and becomes inclined obliquely when compared with its normal position. When the heating roller 41 becomes inclined in this way, the insulating resin bearing 60B having already become fused at the other end side of the roller 41 contacts the second conductive portion 68. However, since the insulating resin bearing 60B is an insulator, the electric current does not flow from the second conductive portion 68 to the insulating resin bearing 60B.

Further, at this time, the heating roller 41 nearly comes into contact the temperature fuse 69. However, since the temperature fuse 69 is sheathed with the insulating tube 71, an electric current does not flow from the temperature fuse 69 to the heating roller 41. Moreover, even when driving force is still transmitted to the gear G and rotation of the heating roller 41 is continued, the insulating tube 71 rotates with respect to the temperature fuse 69, thereby allowing the rotational force of the heating roller 41 to be released.

Therefore, even when the bearings 60A and 60B are fused as mentioned above, electric current can flow along a normal route, such as that indicated by an arrow in the drawing, without involvement of occurrence of a short circuit between the second conductive portion 68 and the heating roller 41.

According to the above descriptions, the present embodiment can yield the following advantages.

The insulating resin bearing 60B prevents occurrence of a short circuit between the second conductive portion 68 and the heating roller 41, and the insulating tube 71 prevents occurrence of a short circuit between the temperature fuse 69 and the heating roller 41. Accordingly, infliction of damage to the device, which would otherwise be induced by a short circuit, can be prevented.

Since the heat is discharged toward the area for which measures against a short circuit have already been taken by means of the insulating resin bearing 60B and the insulating tube 71, the heating roller 41 is inclined obliquely, thereby preventing occurrence of a contact between other structures for which no measures against a short circuit are taken and the heating roller 41. Specifically, in the present embodiment, the heating roller can be prevented from contacting the thermostat 70 for which measures against a short circuit are not taken.

Since the exhaust fan 73 is placed at the position opposite to the gear G, a gear train which is engaged with the gear G can be arranged compactly without taking into account the presence of the exhaust fan 73. Hence, the structure of the heating roller facing the gear G can be embodied in the minimum size that allows incorporation of the gear train. This makes it possible to attempt to miniaturize the overall apparatus.

The rotation of the insulating tube 71 prevents rubbing of the heating roller 41 against the insulating tube 71 (release of rotational force). Hence, even when the insulating tube 71 is formed by wrapping; e.g., an insulating tape, the insulating tube 71 does not peel off from the temperature fuse 69. Therefore, occurrence of a short circuit can be prevented without fail by means of the insulating tube 71.

The present invention is not limited to the first embodiment and can be utilized in various forms as exemplified below.

In the first embodiment, both the insulating resin bearing 60B and the insulating tube 71 are adopted. However, the present invention is not limited to this embodiment. For instance, in the case of a structure where, when the bearing has become fused, the other end of the heating roller 41 and the bearing does not contact the second conductive portion 68 and contacts only the temperature fuse 69, the bearing to be positioned on the other end side of the heating roller 41 does not need to be embodied as an insulator. Even in this case, occurrence of a short circuit can be prevented by means of the insulating tube 71.

Second Embodiment

Figure 5:
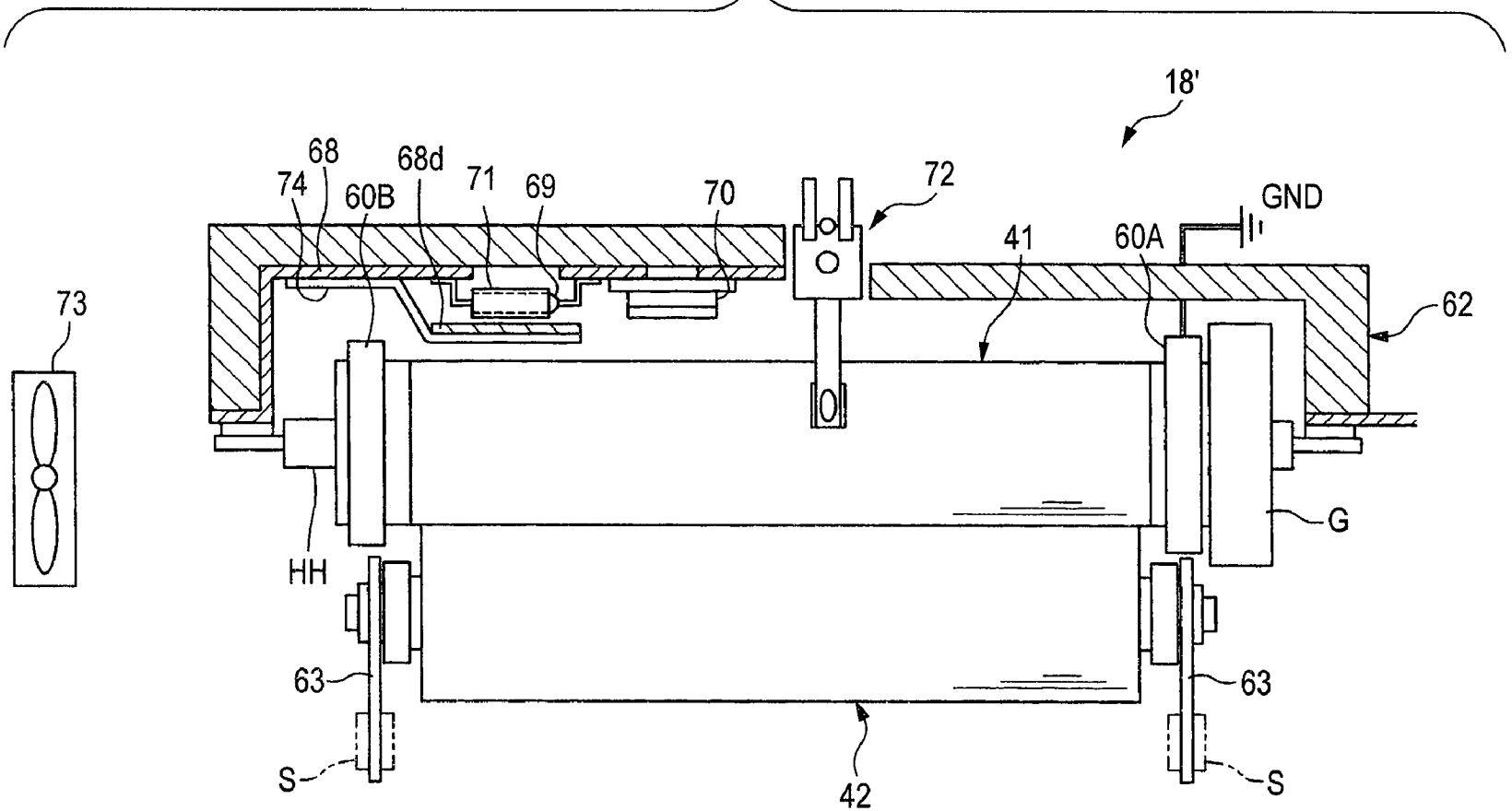
FIG. 5 is a schematic diagram showing a fixing device of a second embodiment of the present invention.

Next, a second embodiment of the present invention will be described in detail, as appropriate, by reference to the drawings. Since the present embodiment relates to a modification on a part of the structure of the fixing device 18 of the first embodiment, the same reference numerals are assigned to the constituent elements analogous to those of the first embodiment, and their explanations are omitted. FIG. 5 is a schematic diagram of the fixing device of the second embodiment.

As shown in FIG. 5, a fixing device 18' of the second embodiment differs from that of the first embodiment. A cover portion 62*d* formed as a part of the housing 62 is disposed between the temperature fuse 69 and the heating roller 41. An insulating tape 74 is affixed so as to extend from this cover portion 62*d* to a position opposing the insulating resin bearing 60B of the second conductive portion 68. It is better to adopt; for example, a polyester adhesive tape, a polyimide adhesive tape, or an acetate adhesive tape, as the insulating tape 74.

According to the above descriptions, the second embodiment can yield the following advantages.

Since the insulating tape 74 is provided between the second conductive portion 68 and the insulating resin bearing 60B, occurrence of a short circuit between the second conductive portion 68 and the heating roller 41 can be inhibited more thoroughly.

The temperature fuse 69 is protected by the cover portion 62*d* and the insulating tape 74 as well as by the insulating tube 71. Accordingly, occurrence of a short circuit between the temperature fuse 69 and the heating roller 41 can be prevented more thoroughly.

The present invention is not limited to the second embodiment and can be utilized in various forms, such as those exemplified below.

In the second embodiment, the insulating tape 74 is adopted as an example insulator to be interposed between the second conductive portion 68 and the insulating resin bearing 60B. However, the present invention is not limited to this. For instance, a rubber-molded article or a plastic-molded article which is fixed to the housing 62, a silicon-based insulating film applied over the surface of the second conductive portion 68, and the like, may also be adopted.

The present invention is not limited to the previously-described embodiments and can be utilized in various forms as exemplified below.

In the respective embodiments, the laser printer 1 is exemplified. However, the present invention is not limited to this printer and may also be applied to another image forming apparatus; for example, a copier, a multifunction machine, or the like.

In the respective embodiments, the transfer roller 30 is adopted as an example of a transfer unit. However, the present invention is not limited to this type of transfer unit, and; for example, a transfer roller of noncontact type may also be adopted.

In the respective embodiments, the sheet 3, such as cardboard, a postcard, or thin paper, is adopted as an example of a recording sheet. However, the present invention is not limited to these types of paper. For example, an OHP sheet may also be adopted.

In the respective embodiments, the tension spring S is adopted as an example of an urging unit. However, the present invention is not limited to the spring. For instance, a press spring, a torsion spring, and the like, may also be adopted.

In the respective embodiments, the halogen heater HH is adopted as an example of a heat source. However, the present invention is not limited to this heater. For instance, a heater of induction heating (IH) type, a heating resistor, and the like, may also be adopted.

In the respective embodiments, toner is adopted as example developer; the developing cartridge 28 is adopted as example developing unit; the scanner unit 16 is adopted as an example of an exposure device; and the photosensitive drum 27 is adopted as an example of an photosensitive element. However, the present invention is not limited to them. Needless to say, a material and a structure can be modified, as appropriate, so long as the modifications are consistent with the gist of the present invention.

In the respective embodiments, the power supply member, such as the second conductive portion 68 and the temperature fuse 69, is disposed across the heating roller 41 from the pressing roller 42. However, the present invention is not limited to this layout, but the power supply member may be disposed in the vicinity of the insulating resin bearing 60B. For instance, the power supply member may also be disposed forward or backward of the heating roller 41 shown in FIG. 2 (at one end side or the other end side of the pressure arm 63; see FIG. 3). Even in this case, the fused bearing may contact the power supply member and hence the structure described the embodiment is effective.

In the respective embodiments, the intake-type exhaust fan 73 is provided at the other end side of the heating roller 41. However, the present invention is not limited to the exhaust fan of this type and this layout. An exhaust fan of emission type may also be disposed at one end side of the heating roller 41. Even in this case, heat can be discharged toward the other end side of the heating roller 41 for which measures against a short circuit have already been taken. Hence, infliction of damage to the apparatus can be prevented.

In the respective embodiments, the intake-type exhaust fan 73 is mentioned as an example of an exhaust unit. However, the present invention is not limited to this unit. For example, an exhaust nozzle connected to a main unit of an air blower by way of a tube, or the like, may also be adopted.

In the respective embodiments, the bearing disposed at the other end side of the heating roller 41 is embodied as an insulating bearing. However, the present invention is not limited to the bearing of this type. For instance, when there is a concern about only a contact between the temperature fuse 69 and the heating roller 41, such as in a case where the second conductive portion 68 is embedded in the housing 62 in connection with the configuration shown in FIG. 2, the bearing disposed on the other end side of the heating roller 41 may also be embodied as a conductive bearing. Even in such a case, since the temperature fuse 69 is provided with the insulating tube 71 in a rotatable manner, occurrence of a short circuit between the heating roller 41 and the temperature fuse 69 is prevented.

What is claimed is:

1. A fixing device for thermally fixing an image developed on a recording sheet, comprising:

a heat source;

a heating roller surrounding the heat source, the heating roller configured to rotate and to be heated by the heat source and having a first end side and a second end side with respect to an axial direction;

a power supply member for supplying the heat source with power for use in heating the heating roller;

a first bearing formed of a conductive material, attached to an outer surface of the first end side of the heating roller and connected to a ground; and an second bearing formed of an insulating material and attached to the second end side of the heating roller, wherein the power supply member is disposed at the second end side of the heating roller.

2. The fixing device according to claim 1, further comprising a pressing member that is urged toward the heating roller.

3. The fixing device according to claim 2, wherein the power supply member is disposed across the heating roller from the pressing member.

4. The fixing device according to claim 1, wherein an exhaust unit that discharges an air from the first end side of the heating roller to the second end side thereof and that is disposed at one of the first end side and the second end side of the heating roller.

5. The fixing device according to claim 4, further comprising a gear that transmits driving force to the heating roller and that is disposed at an end of the heating roller opposite to the side where the exhaust unit is provided.

6. The fixing device according to claim 1, further comprising an insulating member disposed between the power supply member and the second bearing.

7. The fixing device according to claim 2, wherein the power supply member includes a temperature fuse that shuts off a power supply when a predetermined temperature or more is achieved and disposed at a position across the heating roller from the pressing member and at the second end side of the heating roller; and wherein the temperature fuse is sheathed with an insulating tube.

8. The fixing device according to claim 7, wherein an axial direction of the insulating tube is aligned with the heating roller, and the insulating tube is rotatably arranged around the temperature fuse.

9. The fixing device according to claim 7, wherein the power supply member further includes a thermostat, wherein the thermostat and the temperature fuse are disposed substantially along the axial direction of the heating roller, and wherein the thermostat is disposed nearer to an end of the first end side of the heating roller in relation than the temperature fuser.

10. The fixing device according to claim 9, wherein the power supply member further includes a thermistor disposed nearer to an end of the first end side of the heating roller than the thermostat.

11. The fixing device according to claim 1, wherein the power supply member is disposed at least a position opposing to the second bearing with respect to the axial direction of the heating roller.

12. The fixing device according to claim 11, wherein the power supply member contains an exposed conductive portion located at the position opposing to the second bearing.

13. The fixing device according to claim 1, wherein the power supply member is disposed to oppose to a region of the heating roller which is defined between an end of the second end side of the heating roller and a substantially center of the heating roller with respect to the axial direction of the heating roller.

14. A fixing device for thermally fixing an image developed on a recording sheet, comprising:

a heating roller configured to rotate and to be heated by a heat source;

a temperature fuse that shuts off a power supply when a predetermined temperature or more is achieved and is disposed to oppose to a circumferential face of the heating roller;

a cylindrical insulating tube that sheathes the temperature fuse and extends from a first end portion thereof to a second end portion thereof in an axial direction thereof;

first and second electrodes disposed on an opposite side of the heating roller with respect to the temperature fuse;

a first connection member that connects one end portion of the temperature fuse and the first electrode, the first connection member having a first opposing portion that opposes the first end portion of the insulating tube in the axial direction; and a second connection member that connects another end portion of the temperature fuse and the second electrode, the second connection member having a second opposing portion that opposes the second end portion of the insulating tube in the axial direction, wherein the first and second end portions of the insulating tube are located closer to a center of the temperature fuse in the axial direction than the first and second opposing portions with respect to the axial direction, and the axial direction of the insulating tube is aligned with the heating roller and the first and second end portions of the insulating tube have an open end, whereby the insulating tube is rotatably arranged around the temperature fuse.

15. The fixing device according to claim 14 further comprising a pressing member urged toward the heating roller, wherein the temperature fuse is disposed at a position across the heating roller from the pressing member.

16. An image forming apparatus for forming an image on a recording sheet, comprising:

an exposure device that performs a scanning operation with a laser beam in accordance with an input signal of the image;

a photosensitive element subjected to the scanning operation , whereby an electrostatic latent image is formed;

a developing unit that supplies the photosensitive element with developer;

a transfer unit that transfers a developed image formed from the developer onto the recording sheet; and a fixing device that thermally fixes the developed image on the recording sheet, wherein the fixing device comprises:

a heat source;

a heating roller surrounding the heat source, the heating roller configured to rotate and to be heated by the heat source and having a first end side and a second end side with respect to an axial direction;

a power supply member for supplying the heat source with power for use in heating the heating roller;

a first bearing that is formed of a conductive material and attached to an outer surface of the first end side of the heating roller and connected to a ground; and an first bearing that is formed of an insulating material and attached to the second end side of the heating roller wherein the power supply member is disposed at the second end side of the heating roller.

17. An image forming apparatus for forming an image on a recording sheet, comprising:

an exposure device that performs a scanning operation with a laser beam in accordance with an input signal of the image;

a photosensitive element subjected to the scanning operation, whereby an electrostatic latent image is formed;

a developing unit that supplies the photosensitive element with developer;

a transfer unit that transfers a developed image formed from the developer onto the recording sheet; and a fixing device that thermally fixes the developed image on the recording sheet, wherein the fixing device comprises:

a heating roller configured to rotate and to be heated by a heat source;

a temperature fuse that shuts off a power supply when a predetermined temperature or more is achieved and is disposed to oppose to a circumferential face of the heating roller;

a cylindrical insulating tube which sheathes the temperature fuse and extends from a first end portion thereof to a second end portion thereof in an axial direction thereof;

first and second electrodes disposed on an opposite side of the heating roller with respect to the temperature fuse;

a first connection member that connects one end portion of the temperature fuse and the first electrode, the first connection member having a first opposing portion that opposes the first end portion of the insulating tube in the axial direction; and a second connection member that connects another end portion of the temperature fuse and the second electrode, the second connection member having a second opposing portion that opposes the second end portion of the insulating tube in the axial direction, wherein the first and second end portions of the insulating tube are located closer to a center of the temperature fuse in the axial direction than the first and second opposing portions with respect to the axial direction, and the axial direction of the insulating tube is aligned with the heating roller and the first and second end portions of the insulating tube have an open end, whereby the insulating tube is rotatably arranged around the temperature fuse.

18. The fixing device according to claim 14, wherein the first connection member extends from the one end portion of the temperature fuse substantially in the axial direction and bent at a first bent portion toward the first electrode, wherein the second connection member extends from the another end portion of the temperature fuse substantially in the axial direction and bent at a second bent portion toward the second electrode, wherein the insulating tube is disposed between the first and second bent portions in the axial direction such that the first and second bent portions are exposed from the insulating tube.

19. The image forming apparatus according to claim 18, wherein the first connection member extends from the one end portion of the temperature fuse substantially in the axial direction and bent at a first bent portion toward the first electrode, wherein the second connection member extends from the another end portion of the temperature fuse substantially in the axial direction and bent at a second bent portion toward the second electrode, wherein the insulating tube is disposed between the first and second bent portions in the axial direction such that the first and second bent portions are exposed from the insulating tube.

* * * * *